US006222313B1

(12) United States Patent
Smith et al.

(10) Patent No.: US 6,222,313 B1
(45) Date of Patent: Apr. 24, 2001

(54) FIELD EMISSION DEVICE HAVING A SPACER WITH AN ABRADED SURFACE

(75) Inventors: Peter A. Smith; Joyce K. Yamamoto, both of Chandler; Scott K. Ageno, Phoenix, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/209,848

(22) Filed: Dec. 11, 1998

(51) Int. Cl.[7] ..... H01J 1/62
(52) U.S. Cl. ..... 313/495; 313/292
(58) Field of Search ..... 313/495, 496, 313/493, 292, 497, 258

(56) References Cited

U.S. PATENT DOCUMENTS 5,019,306 * 5/1991 Huang et al. ..... 501/134
5,598,056 1/1997 Jin et al. ..... 313/495
5,939,822 * 8/1999 Alderson ..... 313/495

* cited by examiner

*Primary Examiner*—Vip Patel
*Assistant Examiner*—Joseph Williams
(74) *Attorney, Agent, or Firm*—S. Kevin Pickens; James E. Klekotka

(57) ABSTRACT

A field emission display (100) includes a cathode plate (110) having a plurality of electron emitters (119), an anode plate (120) having a plurality of phosphors (126), and a spacer (130) having a rough surface (140). The roughness of rough surface (140) is selected to improve the charging and discharging characteristics of field emission display (100). Preferably, rough surface (140) is characterized by a peak-to-valley number within a range of 0.5–6 micrometers.

5 Claims, 1 Drawing Sheet

FIELD EMISSION DEVICE HAVING A SPACER WITH AN ABRADED SURFACE

FIELD OF THE INVENTION

The present invention relates, in general, to field emission devices, and, more particularly, to spacers for field emission devices.

BACKGROUND OF THE INVENTION

Field emission displays are well known in the art. A field emission display includes an anode plate and a cathode plate that define a thin envelope. Typically, the anode plate and cathode plate are thin enough to necessitate some form of a spacer structure to prevent implosion of the device due to the pressure differential between the internal vacuum and external atmospheric pressure. The spacers are disposed within the active area of the device, which includes the electron emitters and phosphors.

The potential difference between the anode plate and the cathode plate is typically within a range of 300–10,000 volts. To withstand the potential difference between the anode plate and the cathode plate, the spacers typically include a dielectric material. Thus, the spacers have dielectric surfaces that are exposed to the evacuated interior of the device.

During the operation of the field emission display, electrons are emitted from electron emitters, such as Spindt tips, at the cathode plate. These electrons traverse the evacuated region and impinge upon the phosphors. Some of these electrons may strike the dielectric surfaces of the spacers. In this manner, the dielectric surfaces of the spacers become charged. Typically, the dielectric spacers become positively charged because the secondary electron emission coefficient of the spacer material is initially greater than one.

Numerous problems arise due to the charging of dielectric surfaces within a field emission display. For example, control over the trajectory of electrons adjacent to the spacers becomes impaired. Also, the risk of electrical arcing events can increase dramatically.

Accordingly, there exists a need for a spacer for a field emission device having improved surface charging characteristics.

BRIEF DESCRIPTION OF THE DRAWINGS

Referring to the drawings.

Figure 1:
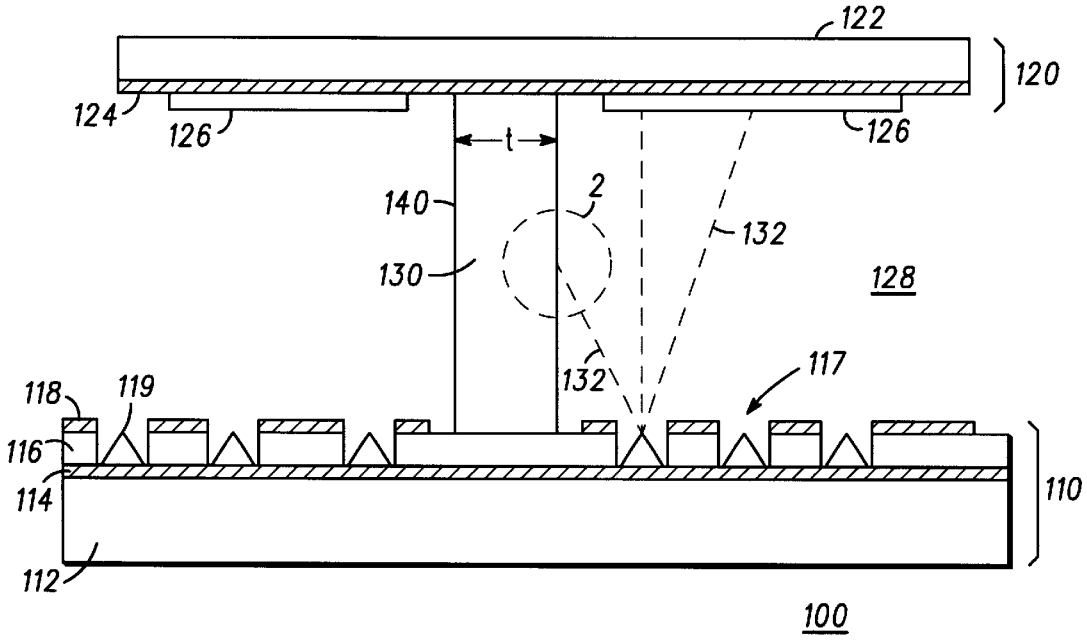
FIG.1 is a cross-sectional view of a field emission display having a spacer in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device having spacers with surfaces characterized by controlled roughness. The roughness of the spacer surfaces is selected to control the rate of electrical charging of the spacer surfaces during operation of the device. For example, reduction of the rate of electrical charging can be useful for relaxing both the power requirements of the device and the frequency of a discharging method employed to remove surface charge during the operation of the device.

FIG.1 is a cross-sectional view of a field emission display (FED) 100 having a spacer 130 in accordance with a preferred embodiment of the invention. FED 100 includes a cathode plate 110 and an anode plate 120, which are spaced apart to define an interspace region 128. FED 100 further includes spacer 130 positioned within interspace region 128. Cathode plate 110 and anode plate 120 are spaced apart by spacer 130.

Cathode plate 110 includes a substrate 112, which can be made from glass, silicon, and the like. A plurality of conductive columns 114 is disposed upon substrate 112. A dielectric layer 116 is disposed upon conductive columns 114 and further defines a plurality of wells 117.

An electron emitter 119 is disposed in each of wells 117. Anode plate 120 is disposed to receive an electron beam 132 emitted by electron emitters 119. A plurality of conductive rows 118 is formed on dielectric layer 116 proximate to wells 117. Conductive columns 114 and conductive rows 118 are useful for selectively addressing electron emitters 119. Methods for fabricating cathode plates for matrix-addressable field emission displays are known to one of ordinary skill in the art.

Anode plate 120 includes a transparent substrate 122 made from, for example, glass. An anode 124 is disposed on transparent substrate 122. Anode 124 is preferably made from a transparent conductive material, such as indium tin oxide. A plurality of phosphors 126 is disposed upon anode 124. Methods for fabricating anode plates for matrix-addressable field emission displays are also known to one of ordinary skill in the art.

Spacer 130 can be made from a ceramic dielectric material, a bulk resistive material, or a combination thereof. Preferably, spacer 130 is made from $BaNd_2Ti_5O_{14}$. Most preferably, spacer 130 is made from a material having a major phase, which is defined by $BaNd_2Ti_5O_{14}$. Spacer 130 can be a thin plate, a rib, or one of numerous other shapes. Furthermore, spacer 130 can be made from a unitary structure, having uniform material properties. Alternatively, spacer 130 can include multiple layers of distinct materials.

In accordance with the invention, spacer 130 has a rough surface 140. Preferably, rough surface 140 is an abraded surface.

Figure 2:
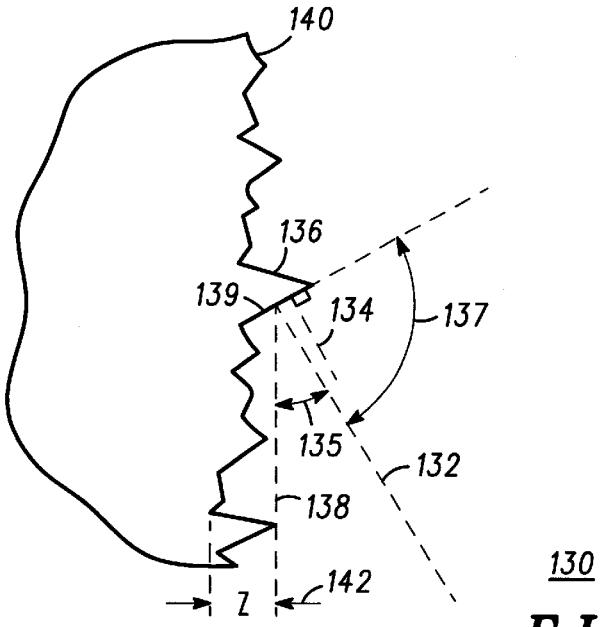
FIG.2 is a greatly enlarged partial view of a surface of the spacer of FIG. 1.

FIG.2 is a greatly enlarged partial view of rough surface 140 of spacer 130 of FIG.1. At the macroscopic level, rough surface 140 defines a plane 138, as indicated by a dashed line in FIG.2. At the microscopic level, and as further illustrated in FIG.2, rough surface 140 defines a plurality of peaks 136, which define a plurality of peak-to-valley distances 142, Z. Peak-to-valley distances 142 are non-uniform over rough surface 140.

During the operation of the device, a portion of electron beam 132 can impinge upon rough surface 140. As illustrated in FIG.2, electron beam 132 defines a macroscopic angle 135 of incidence (between 0–90 degrees) with respect to plane 138. Electron beam 132 also defines a microscopic angle 137 of incidence with respect to a surface 139 of one of peaks 136. Peak-to-valley distance 142 can be selected such that microscopic angle 137 equals 90 degrees with respect to surface 139 of peak 136. The resulting benefit is that, as the incident portion of electron beam 132 approaches a normal 134 of surface 139, the secondary electron emission coefficient is reduced, resulting in less surface charging than occurs at glancing angles of incidence.

The roughness of rough surface 140 can be characterized by the average peak-to-valley distance, the peak-to-valley number, over rough surface 140. The peak-to-valley number can be measured using an atomic force microscope, which is useful for measuring the topology of a surface. In general, the roughness and the peak-to-valley number are selected to reduce electric discharges at rough surface 140.

The selected value of the peak-to-valley number depends, in part, upon the following: the material properties, such as, for example, the dielectric constant, of spacer 130; the characteristics of the incident electron beam, such as the value of macroscopic angle 135 of incidence; the incident electron flux at rough surface 140; and the selected frequency of the spacer discharge method. An exemplary set of conditions includes: macroscopic angle 135 of incidence equal to about 5°; an incident electron flux of about 10_amps/cm$^2$; and a spacer discharge frequency of about 30 Hz. Each of the following adjustments permit a reduction in the extent of roughness of rough surface 140: an increase in the value of the dielectric constant, if spacer 130 is made from a dielectric material; an increase in macroscopic angle 135; a lower incident electron flux; and an increase in the frequency of the discharging method.

The selected value of the peak-to-valley number further depends upon the effective period of peaks 136. Generally, the peak-to-valley number increases with an increase in the effective period of peaks 136.

Preferably, rough surface 140 is characterized by a peak-to-valley number within a range of 0.5–6 micrometers. Most preferably, rough surface 140 is characterized by a peak-to-valley number within a range of 0.5–3.2 micrometers.

Spacer 130 can be made using one of several convenient methods. In a first example, spacer 130 having a rib shape is made by first providing a sheet of the spacer material. The thickness of the sheet is selected to be about equal to the desired thickness, t, of spacer 130.

Prior to defining the individual ribs, the opposing surfaces of the sheet are roughened using any one of a number of convenient roughening techniques. The surface of the sheet is roughened to an extent suitable to provide the desired value of the peak-to-valley number for rough surface 140 of spacer 130. The roughening can be achieved by abrasion, such as by polishing, grinding, and the like, so that rough surface 140 is an abraded surface. The variables of the roughening method are adjusted to provide the desired roughness characteristics. For example, if a slurry is used to abrade the surfaces, the adjustable parameters include the particle size and particle size distribution of the slurry, the viscosity of the slurry, the pressure of the particles on the surface, and the duration of the processing. After the step of roughening the surfaces of the sheet, the individual spacers are cut from the sheet, using, for example, a saw or water knife.

In a second example for fabricating spacer 130, rough surface 140 is formed during the step of cutting the sheet of spacer material into individual ribs. In this example, the sheet has a thickness equal to the desired height of spacer 130. The sheet is cut into individual ribs, using, for example, a dicing saw or a wire saw. The extent of roughness can be controlled by controlling the particle size of the slurry used with the saw and by the selection of the type of grit material. The extent of roughness can also be controlled by controlling the rotational and translational speeds of the saw.

A roughened surface can also be achieved using controlled ceramic processing techniques, such as precursor powder processing, thermal treatment, and the like. Achieving roughness can be facilitated by reducing the density of the material, such as by pinning grain boundaries with additives, introducing a fugitive phase, utilizing less than optimal particle packing during precursor processing, and the like.

The operation of FED 100 will now be described with reference to FIG. 1. The operation of FED 100 is characterized by two modes of operation: a scanning mode and a discharge mode. During the scanning mode, electrical potentials are sequentially applied to conductive rows 118. By scanning it is meant that a potential suitable for causing electron emission is selectively applied to the scanned row. During the time that one of conductive rows 118 is scanned, potentials are applied to conductive columns 114 according to video data. Whether each of electron emitters 119 within a scanned row is caused to emit electrons depends upon the video data and the voltage applied to each of conductive columns 114. Electron emitters 119 in the rows not being scanned are not caused to emit electrons.

During the scanning mode of operation, a voltage is applied at anode 124. This voltage is selected to attract electron beam 132 toward anode plate 120 and to provide a desired level of brightness of the image generated by phosphors 126.

During the scanning mode, most of the electrons emitted by electron emitters 119 strike anode plate 120. However, some of the emitted electrons impinge upon rough surface 140, electrostatically charging rough surface 140. The charged surface causes undesirable effects, such as adversely affecting the control of electron beam 132.

The discharge mode of operation of FED 100 is characterized by a discharging method for removing the surface charge at spacer 130. An example of a useful discharging method includes two steps. First, the anode voltage is reduced from a scanning mode value to a discharge mode value. Thereafter, electron emitters 119 are caused to emit simultaneously to produce a discharge current. The discharge current is useful for neutralizing the charged surface. The anode voltage is reduced by an amount sufficient to allow the discharge current to be directed toward the charged surfaces. After neutralization of the charged surfaces, the anode voltage is returned to its scanning mode value.

A field emission device in accordance with the invention is useful for reducing the frequency of alternation between the scanning and discharge modes of operation, when contrasted with a device having, for example, smooth spacer surfaces. One advantage of the reduced frequency is that multiple display frames can be executed within each cycle. For the exemplary discharging method described above, a reduction in frequency of the discharging method entails a reduction in frequency of the switching of the anode voltage. A reduced rate of switching of the anode voltage results in numerous benefits, such as lower power consumption and lower operating costs.

In summary, the invention is for a field emission device having spacers with rough surfaces. The roughness characteristics are selected to improve the charging and discharging characteristics of the device. The field emission device of the invention provides numerous benefits, such as improved power requirements, lower operating costs, "invisibility" of spacers, and improved control over electron trajectories.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention. For example, the invention can be embodied by devices other than field emission displays, such as matrix-addressable electron sources for electron lithography, microwave amplifier tubes, and the like.

What is claimed is:

1. A field emission device (100) comprising:

a cathode plate (110) having a plurality of electron emitters (119);

an anode plate (120) disposed to receive electrons (132) emitted by the plurality of electron emitters (119), the cathode plate (110) and the anode plate (120) defining an interspace region (128); and a spacer (130) disposed within the interspace region (128), the spacer comprising a ceramic dielectric material and defining an abraded surface (140), the abraded surface defining a plurality of peaks (136), which define a plurality of non-uniform peak-to-valley distances (142).

2. The field emission device (100) as claimed in claim 1, wherein the roughness of abraded surface (140) being characterized by an average peak-to-valley distance, the average peak-to-valley distance defining a peak-to-valley number over the abraded surface (140), wherein the abraded surface (140) is characterized by a peak-to-valley number within a range of 0.5–6 micrometers.

3. The field emission device as claimed in claim 2, wherein the abraded surface is characterized by a peak-to-valley number within a range of 0.5–3.2 micrometers.

4. The field emission device as claimed in claim 1, wherein the spacer comprises $BaNd_2Ti_5O_{14}$.

5. The field emission device (100) as claimed in claim 1, wherein the spacer (130) comprises a material having a major phase, and wherein the major phase is defined by the $BaNd_2Ti_5O_{14}$.

* * * * *